United States Patent [19]

O'Herien

[11] 4,097,018

[45] Jun. 27, 1978

[54] RIFLE PELLET CASTING MOLD

[75] Inventor: Charles R. O'Herien, Canastota, N.Y.

[73] Assignee: The Raymond Lee Organization, Inc., New York, N.Y. ; a part interest

[21] Appl. No.: 739,697

[22] Filed: Nov. 8, 1976

[51] Int. Cl.[2] ..... B22C 9/06; B22C 9/08

[52] U.S. Cl. ..... 249/105; 164/264; 164/339; 249/172

[58] Field of Search ..... 249/105, 170, 171, 172; 164/69, 70, 262, 264, 344, 339

[56] References Cited

U.S. PATENT DOCUMENTS

| | | | |
|---|---|---|---|
| 30,054 | 9/1860 | Evans | 164/264 |
| 2,114,015 | 4/1938 | Cramer | 164/264 |
| 3,870,272 | 3/1975 | Jackman | 249/170 |

*Primary Examiner*—Francis S. Husar
*Assistant Examiner*—Gus T. Hampilos

[57] ABSTRACT

A mold having a bottom section hinged to a side section and the side section pivotally attached to a second side section can be assembled using a pin in the bottom section engaging the side section and a pin in the second side section engaging the first side section to form a rigid structure held together by a handle, the assembled mold forms a sprue through which a casting material can be poured and a gate carrying the casting material into a mold formed in the rifle pellet casting mold to form pellets of various types such as the round headed type the pointed type the flat face type and the rifle type.

6 Claims, 6 Drawing Figures

RIFLE PELLET CASTING MOLD

I have invented a new and novel rifle pellet casting mold. My rifle pellet casting mold can be used to provide various styles of pellets and uses pouring sprews and gates to regulate the flow of the pellet material into the molds as well as pins to insure rigid assembly of the mold before casting begins.

My invention can be understood in view of the accompanying figures.

Figure 1:
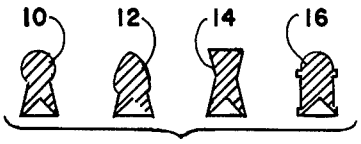
FIG. 1 is a cross sectional view of a group of different types of pellets which may be cast by the mold.
Figure 2:
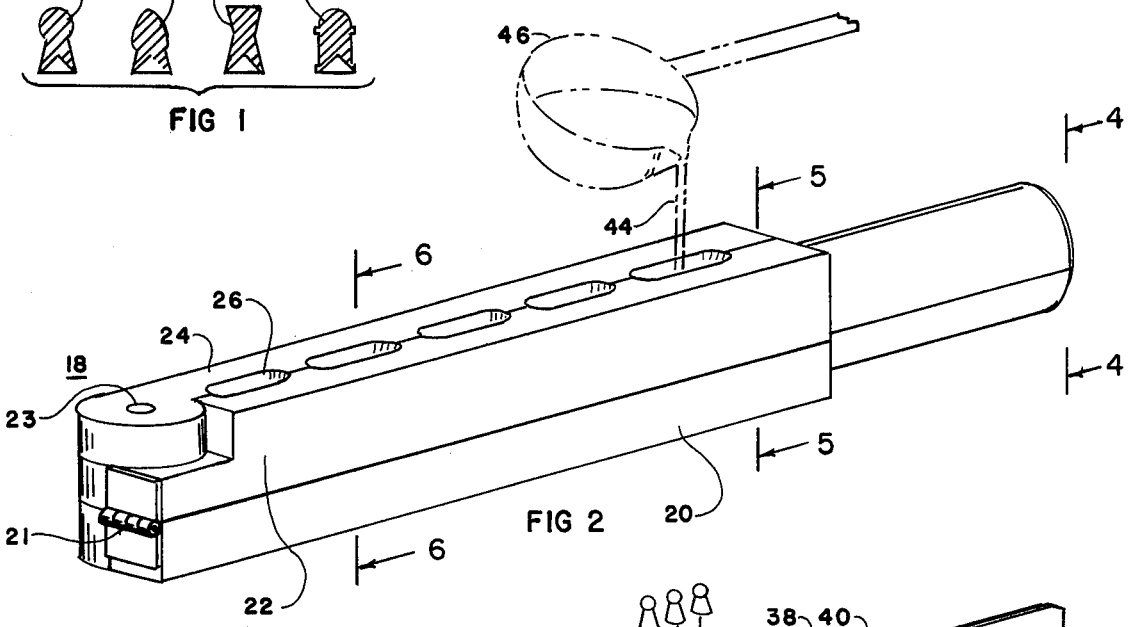
FIG. 2 is a perspective view of the mold in use.
Figure 3:
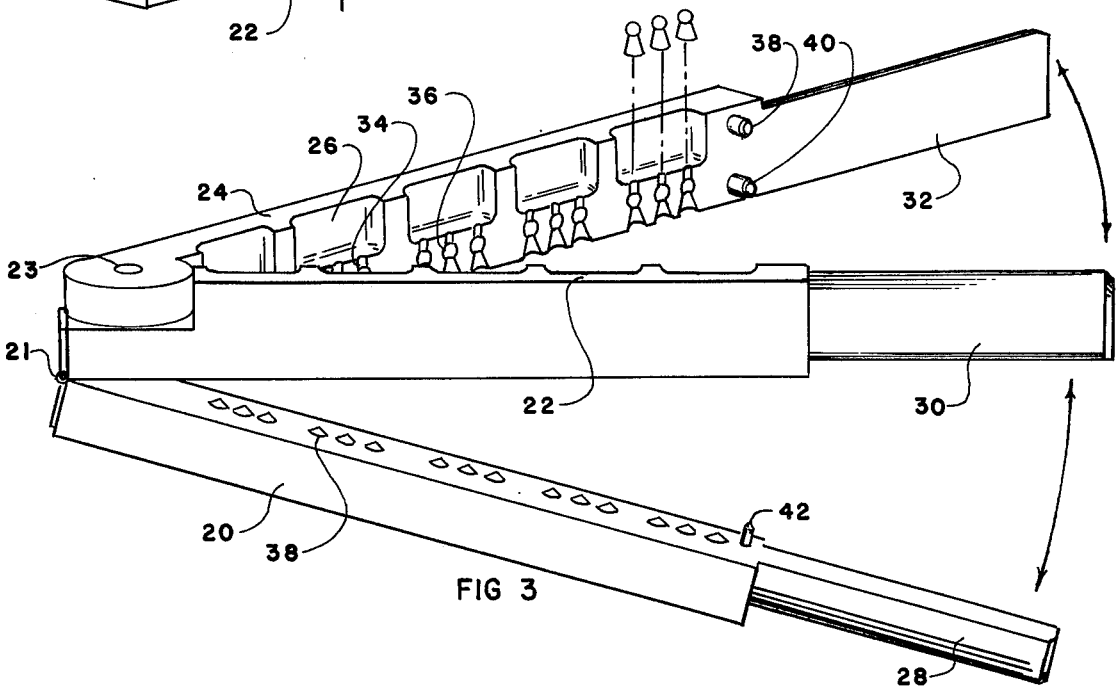
FIG. 3 is a view of the mold opened for removal of the cast pellets.
Figure 4:
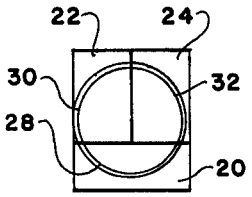
FIG. 4 is a view of the mold taken along the plane 4—4 of FIG. 2.
Figure 5:
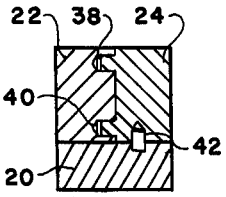
FIG. 5 is a cross sectional view of the mold taken along the plane 5—5 of FIG. 2.
Figure 6:
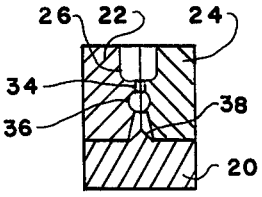
FIG. 6 is a cross sectional view of the mold taken along the plane 6—6 of FIG. 2.

With regard to FIG. 1, a variety of types of rifle pellets may be cast in the mold of this disclosure including a round headed pellet 10 a pointed pellet 12 a flat faced pellet 14 and a rifle type pellet 16 depending upon the construction of each of the individual mold chambers.

With regard to FIGS. 2, 3, 4, 5, and 6, the mold 18 is seen to consist of a bottom section 20 hinged 21 to a side section 22 which is pivotally attached 23 to a second side section 24. The closed mold 18 forms sprues 26 through which the molten material may be poured once the handle sections 28 30 and 32 are connected.

The molten material passes through the gates 34 into the mold cavities proper 36. The mold cavities proper 36 are kept in proper alignment by the insertion of the pins 38 and 40 attached to mold section 24 into the body of mold section 22 to provide vertical rigidity to the mold and the insertion of vertical pin 42 mounted in the bottom section 20 into the side section 24 to provide for lateral rigidity. The molten material 44 can be poured from a ladle 46 into the sprues 26.

I claim:

1. A rifle pellet casting mold, comprising:

a bottom section hingedly attached to a side section, the side section pivotally attached to a second side section, means for rigidly securing the sections together attached to the sections, the assembled side sections forming a sprue through which a molten material may be poured, a side section forming a gate connected to the sprue, & the sections forming a mold connected to the gate, whereby a pellet may be cast.

2. The mold of claim 1, further comprising:

the base section forming a handle portion, the side section forming a handle portion, and the second side section forming a handle portion, whereby the handle sections may be assembled to form a handle which can be held to keep the mold assembled while forming the pellets.

3. The mold of claim 2, wherein the means for maintaining rigidity comprises a pin mounted in the bottom section and engageable with the side section and a pin mountable in the side section and engageable with the second side section.

4. The mold of claim 3, wherein the mold is of the type to form a round headed pellet.

5. The rifle pellet casting mold of claim 3, wherein the mold is of the type to form a pointed pellet.

6. The mold of claim 3, wherein the mold is of the flat faced pellet type.

* * * * *